United States Patent [19]

Matsuda et al.

[11] Patent Number: 4,804,444

[45] Date of Patent: Feb. 14, 1989

[54] METHOD OF PRODUCING A BOTH-SIDE ELECTROGALVANIZED STEEL STRIP IN A CHLORIDE BATH

[75] Inventors: Akira Matsuda; Hajime Kimura, both of Chiba, Japan

[73] Assignee: Kawasaki Steel Corporation, Kobe, Hyogo, Japan

[21] Appl. No.: 104,524

[22] Filed: Sept. 30, 1984

Related U.S. Application Data

[63] Continuation of Ser. No. 637,218, filed as PCT JP83/00147 on May 18, 1983, published as WO84/04548 on Nov. 22, 1984 abandoned.

[51] Int. Cl.[4] ..... C25D 7/06

[52] U.S. Cl. ..... 204/28; 204/29; 204/35.1; 204/40

[58] Field of Search ..... 204/27, 28, 29, 32.1, 204/35.1, 40

[56] References Cited

U.S. PATENT DOCUMENTS

| | | | |
|---|---|---|---|
| 2,933,438 | 4/1960 | Lancy | 204/28 |
| 3,483,113 | 12/1969 | Carter | 204/206 |
| 3,591,467 | 7/1977 | Carter | 204/28 |
| 3,989,604 | 11/1976 | Austin | 204/28 |
| 4,120,997 | 10/1978 | Franks | 427/367 |

OTHER PUBLICATIONS

A Kenneth Graham, *Electroplating Engineering Handbook*, Reinhold Publishing Corp., New York, 2nd edition, 1962, pp. 705–709.

Metal Finishing Guidebook and Directory for 1978, Metals and Plastics Publications, Inc. Hackensack, N.J., p. 340.

*Primary Examiner*—John F. Niebling
*Assistant Examiner*—William T. Leader
*Attorney, Agent, or Firm*—Balogh, Osann, Kramer, Dvorak, Genova & Traub

[57] ABSTRACT

A method of producing both-side electrolytically zinc plated steel strips utilizing a chloride bath including the steps of plating one side of the steel strip in a first plating cell, wetting the thus one-side plated steel strip in a wetting tank, and then plating the other nonplated side of the steel strip in a second plating cell. The method provides for limiting the concentration of zinc in the wetting solution to a range of 0.1–50 g/l so as to improve the zinc coating coverage, glossiness and corrosion resistance.

1 Claim, 1 Drawing Sheet

METHOD OF PRODUCING A BOTH-SIDE ELECTROGALVANIZED STEEL STRIP IN A CHLORIDE BATH

This application is a continuation, of application Ser. No. 637,218, filed July 20, 1984, now abandoned which is based on PCT/JP83/00147, filed 5/18/83, published as WO 84/04548 on Nov. 22, 1984.

TECHNICAL FIELD

This invention relates to a method of producing a both-side electrogalvanized steel strip in a chloride bath which is able to form beautiful and glossy plated surfaces by profitable improvement of zinc coating coverage in the electrogalvanizing with the chloride bath.

BACKGROUND ART

As a plating system in an electrogalvanizing line, there are two systems, one of which being a simultaneous both-side plating system wherein both sides of steel strip are simultaneously electrogalvanized, and the other of which being a both-side separate plating system composed of two-stage plating wherein one side of steel strip is electrogalvanized in a first plating stage and thereafter the opposed side of steel strip is electrogalvanized in a second plating stage.

The both-side separate plating system has some merits that the changeover between both-side coating and one-side coating can be achieved by merely turning over the passing direction of the steel strip to be coated, and the replacement of used electrode with new electrode can be performed simply and hence the workability is excellent.

As the both-side separate plating system, there are a horizontal type as shown in FIG. 1 and a radial type as shown in FIG. 2. In any case, a wetting tank 3 is arranged between a first plating cell 1 and a second plating cell 2. A steel strip 4 is passed through the first and second plating cells 1, 2 by means of conductor rolls 5, during which it is subjected to a galvanizing with an electrolyte 7 through an anode 6 arranged opposite to the steel strip 4.

When the steel strip 4 moves from the first plating cell 1 to the second plating cell 2, it is wetted with a wetting solution 8 in the wetting tank 3. This wetting treatment is carried out in order to introduce the steel strip 4 into the second plating cell 2 at a uniformly wetted condition of the non-plated surface, because when the non-plated surface of the steel strip 4 to be introduced into the second plating cell 2 is completely dry or is locally adhered with the electrolyte, it is apt to produce uneven plating by the second plating treatment.

Heretofore, a sulfate bath consisting essentially of zinc sulfate has mainly been used as an acidic electrolyte for the electrogalvanizing. Lately, a chloride bath becomes frequently used instead of the sulfate bath because of the following merits as compared with the sulfate bath:

(1) Since the electric conductivity is high, the required voltage can be reduced; and (2) Since the acceptable current density is high, the high-speed plating is easy.

Incidentally, when the sulfate bath consisting mainly of zinc sulfate is used as the electrolyte, no care must be particularly taken on the wetting solution in the wetting tank 3. That is, good both-side galvanized steel strip can be obtained by using the electrolyte in itself as the wetting solution.

However, when the chloride bath consisting mainly of zinc chloride is used as the electrolyte, if such an electrolyte in itself is used as the wetting solution in the wetting tank 3, it is confirmed that the zinc coating coverage is extremely lowered in a surface to be plated in the second plating cell 2.

DISCLOSURE OF INVENTION

The invention is to provide a method of producing a both-side electrogalvanized steel strip in a chloride bath which advantageously solves the aforementioned problems of the prior art in the both-side separate plating system by adding a special means to the wetting treatment prior to the second plating treatment.

The essential feature of the invention is as follows.

That is, the invention lies in a method of producing a both-side electrogalvanized steel strip in a chloride bath by plating one side of the steel strip in a first plating cell, wetting the thus one-side plated steel strip in a wetting tank, and then plating the other non-plated side of the steel strip in a second plating cell, characterized in that concentration of zinc in a chloride wetting solution of the wetting tank is 0.1 to B 50 g/l.

The invention will be described concretely based on the following experimental result.

A cold-rolled steel strip having a thickness of 0.8 mm was degreased, pickled, and then subjected on both sides to an electrogalvanizing at each coating amount of 10 g/m$^2$ under the following same plating conditions by varying only the concentration of zinc in the wetting liquid as shown in the following Table 1.

(a) Plating bath: composition $ZnCl_2$=200 g/l, KCl=350 g/l, temperature 55° C., pH=5.0

(b) Line speed: 50 m/min (c) Current density: 50 A/dm$^2$ (d) Plating apparatus: radial type both-side separate plating system first plating cell (bottom surface plating)→wetting tank→second plating cell (top surface plating)

(e) Wetting solution: composition $ZnCl_2$, temperature 40° C., pH=4.5

The zinc coating coverage was observed with respect to the plated surface of each of the steel strips by means of a scanning type electron microscope, and the glossiness of the plated surface (JIS Z8741) was measured by means of a glossmeter. Further, the test specimen was subjected to a humidity cabinet test, and a ratio of red rust produced after 3 days was examined. The thus obtained results are also shown in Table 1.

TABLE 1

| Run No. | Concentration of zinc in wetting solution (g/l) | First plating cell (bottom surface) zinc coating coverage (%) | glossiness (%) | corrosion resistance (%) | Second plating cell (top surface) zinc coating coverage (%) | glossiness (%) | corrosion resistance (%) |
|---|---|---|---|---|---|---|---|
| 1 | 0 | 100 | 50.1 | <5 | 100 | 28.5 | <5 |

TABLE 1-continued

| Run No. | Concentration of zinc in wetting solution (g/l) | First plating cell (bottom surface) zinc coating coverage (%) | glossiness (%) | corrosion resistance (%) | Second plating cell (top surface) zinc coating coverage (%) | glossiness (%) | corrosion resistance (%) |
|---|---|---|---|---|---|---|---|
| 2 | 0.01 | 100 | 50.3 | <5 | 100 | 35.5 | <5 |
| 3 | 0.1 | 100 | 49.8 | <5 | 100 | 48.7 | <5 |
| 4 | 1.0 | 100 | 50.8 | <5 | 100 | 50.9 | <5 |
| 5 | 10.0 | 100 | 50.6 | <5 | 100 | 50.8 | <5 |
| 6 | 50.0 | 100 | 49.2 | <5 | 100 | 50.3 | <5 |
| 7 | 75.0 | 100 | 50.2 | <5 | 70 | 30.5 | 25 |
| 8 | 100.0 | 100 | 50.8 | <5 | 40 | 25.5 | 50 |

As apparent from Table 1, all of the bottom surfaces coated in the first plating cell had the zinc coating coverage of 100% and were good in the glossiness and the corrosion resistance according to the humidity cabinet test. In the top surfaces coated in the second plating cell, however, the zinc coating coverage was changed in accordance with the concentration of zinc in the wetting solution. That is, when the zinc concentration is exceeds 50 g/l, the zinc coating coverage rapidly lowers to leave uncoated portions and hence the corrosion resistance and glossiness are deteriorated, while when it is less than 0.1 g/l, the glossiness lowers.

According to the invention, therefore, the concentration of zinc in the wetting solution to be used in the chloride wetting tank is limited to a range of 0.1 to 50 g/l.

Although the reason why the zinc concentration in the wetting tank has an influence on the zinc coating coverage is not clear, it is anticipated that when the steel strip is previously wetted with a solution having high zinc concentration, zinc is adsorbed on the surface of the strip, and when the wetted strip is subjected to subsequent plating, the selective electrodeposition is promoted because crystals grow about the adsorbed zinc. Thus, it is considered that the crystal growth is preferential rather than the nuclear formation so that the strip surface can not uniformly be coated with zinc and consequently the zinc coating coverage is deteriorated. On the other hand, when the zinc concentration is low, the adsorption of zinc is small, which is considered to have no influence on the subsequent plating.

The composition other than zinc in the wetting solution is not particularly critical, but it is desirable to use the same composition system as in the electrolyte in view of the introduction of the wetted strip into the subsequent plating cell.

The temperature of the wetting liquid is not critical, but it is practically 20°-50° C. And also, pH of the wetting solution does not substantially affect the zinc coating coverage and is not restricted, but is is preferably about 3-6.

The wetting treatment may be carried out in the usual manner such as dipping method, spraying method or the like.

The chloride bath to be used in the invention consists mainly of zinc chloride and, if necessary, contains as a conductive assistant a proper amount of at least one substance selected from ammonium chloride, potassium chloride, sodium chloride, aluminum chloride, barium chloride, calcium chloride and magnesium chloride. In general, the concentration of zinc chloride is within a practical range of 100-300 g/l, and the concentration of chloride as the conductive assistant is 100-450 g/l. Furthermore, other additives such as gloss agent, pH buffer and the like may be added.

As mentioned above, according to the invention, the both-side electrogalvanized steel strip having improved zinc coating coverage, glossiness and corrosion resistance can be produced from the chloride plating cells by adjusting the concentration of zinc in the chloride wetting solution of the wetting tank to a range of 0.1-50 g/l.

BEST MODE OF CARRYING OUT THE INVENTION

Figure 1:
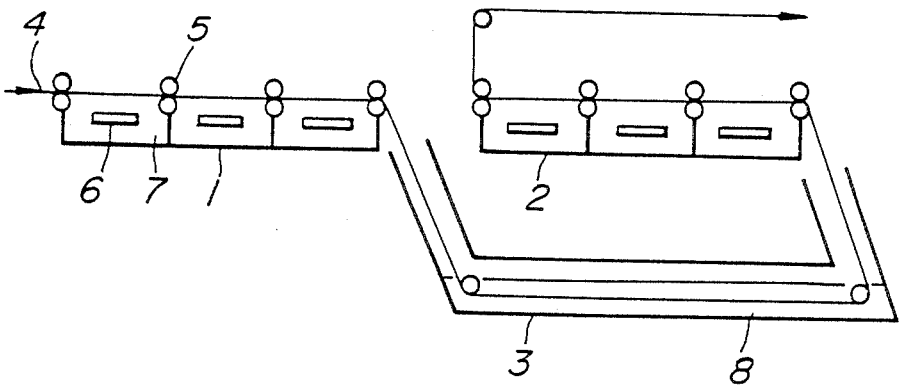
FIG. 1 is a diagrammatical view of a horizontal-type both-side electrogalvanizing line.
Figure 2:
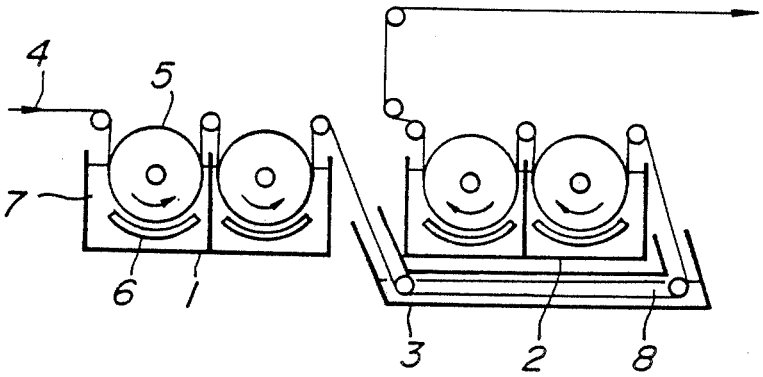
FIG. 2 is a diagrammatical view of a radial-type both-side electrogalvanizing line.

A steel strip was subjected to a both-side electrogalvanizing at a coating weight per one side of 20 g/m$^2$ under the following plating conditions using a combination of a chloride plating bath and a wetting solution each having a composition shown in the following Table 2 and then examined with respect to the zinc coating coverage and glossiness to obtain results as shown in Table 2.

Plating conditions (i) Plating bath: temperature 55° C. pH 5.0

(ii) Wetting solution: temperature 40° C. pH 4.5

(iii) Line speed: 50 m/min, (iv) Current density: 50 A/dm$^2$ (v) Plating system: radial-type both-side separate plating system first plating cell (bottom surface plating)→wetting tank→second plating cell (top surface plating)

TABLE 2(a)

| Run No. | Composition of plating bath | Composition of wetting solution | Concentration of zinc in wetting solution (g/l) | First plating cell (bottom surface) zinc coating coverage (%) | glossiness (%) | Second plating cell (top surface) zinc coating coverage (%) | glossiness (%) | Remarks |
|---|---|---|---|---|---|---|---|---|
| 1 | $ZnCl_2$ 180 g/l<br>$NH_4Cl$ 300 g/l | $ZnCl_2$ 10 g/l<br>$NH_4Cl$ 20 g/l | 4.8 | 100 | 50.3 | 100 | 51.2 | Example according |

TABLE 2(a)-continued

| Run No. | Composition of plating bath | Composition of wetting solution | Concentration of zinc in wetting solution (g/l) | First plating cell (bottom surface) zinc coating coverage (%) | First plating cell (bottom surface) glossiness (%) | Second plating cell (top surface) zinc coating coverage (%) | Second plating cell (top surface) glossiness (%) | Remarks |
|---|---|---|---|---|---|---|---|---|
| 2 | $ZnCl_2$ 220 g/l<br>NaCl 350 g/l | $ZnCl_2$ 75 g/l<br>NaCl 100 g/l | 36 | 100 | 44.6 | 100 | 43.8 | to the invention Example |
| 3 | $ZnCl_2$ 150 g/l<br>$AlCl_3$ 200 g/l | $ZnCl_2$ 1 g/l<br>$AlCl_3$ 2 g/l | 0.5 | 100 | 38.8 | 100 | 39.1 | according to the invention Example |
| 4 | $ZnCl_2$ 250 g/l<br>$BaCl_2$ 150 g/l | $ZnCl_2$ 15 g/l | 7.2 | 100 | 36.6 | 100 | 35.8 | according to the invention Example |
| 5 | $ZnCl_2$ 200 g/l<br>$CaCl_2$ 300 g/l | $ZnCl_2$ 50 g/l | 24 | 100 | 39.6 | 100 | 39.1 | according to the invention Example according to the invention |

TABLE 2(b)

| Run No. | Composition of plating bath | Composition of wetting solution | Concentration of zinc in wetting solution (g/l) | First plating cell (bottom surface) zinc coating coverage (%) | First plating cell (bottom surface) glossiness (%) | Second plating cell (top surface) zinc coating coverage (%) | Second plating cell (top surface) glossiness (%) | Remarks |
|---|---|---|---|---|---|---|---|---|
| 6 | $ZnCl_2$ 300 g/l<br>$MgCl_2$ 150 g/l | $ZnCl_2$ 25 g/l<br>$MgCl_2$ 10 g/l | 12 | 100 | 42.1 | 100 | 43.2 | Example according to the invention |
| 7 | $ZnCl_2$ 200 g/l<br>KCl 150 g/l<br>NaCl 150 g/l | $ZnCl_2$ 10 g/l | 4.8 | 100 | 50.1 | 100 | 50.3 | Example according to the invention |
| 8 | $ZnCl_2$ 180 g/l<br>$NH_4Cl$ 300 g/l | — | 0 | 100 | 50.2 | 100 | 29.6 | Comparative Example |
| 9 | $ZnCl_2$ 220 g/l<br>NaCl 350 g/l | $ZnCl_2$ 270 g/l<br>NaCl 350 g/l | 106 | 100 | 48.7 | 50 | 24.8 | Comparative Example |

As apparent from the results of Table 2, the plated steel strips having good zinc coating coverage and glossiness are obtained in the chloride bath having the composition according to the invention. In Run Nos. 8 and 9 wherein the zinc concentration of the wetting solution is outside the range defined in the invention, the glossiness or zinc coating degree of the plated surface is poor.

As apparent from the above examples, according to the invention, the both-side electrogalvanized steel strip having the improved zinc coating coverage and glossiness can be produced in the chloride bath by limiting the zinc concentration of the wetting solution to 0.1–50 g/l.

Industrial Applicability

In the production of both-side galvanized steel strips according to the invention, very glossy and beautiful plated surface can be obtained even when being subjected to high-speed electrogalvanizing using a chloride bath, so that mass production can easily be realized in industrial scale and also the reduction of the cost is achieved.

We claim:

1. In a method of producing a both-side electrolytically zinc plated steel strip utilizing a chloride plating bath, the method including the steps of electrolytically plating one side of the steel strip in a first plating cell, wetting the thus one-side plated steel strip in a wetting tank, and then electrolytically plating the other non-plated side of the steel strip in a second plating cell, the improvement which comprises wetting the one-side plated steel strip in a chloride wetting solution having a concentration of zinc in a range of 0.1 to 50 g/l, so as to produce the both-side electro-galvanized steel strip having improved zinc coating coverage, glossiness and corrosion resistance and utilizes a chloride bath in the first and second plating cells which comprises 150–300 g/l of zinc chloride.

* * * * *

UNITED STATES PATENT AND TRADEMARK OFFICE

CERTIFICATE OF CORRECTION

PATENT NO. : 4,804,444

DATED : February 14, 1989

INVENTOR(S) : Akira Matsuda; Hajime Kimura

It is certified that error appears in the above-identified patent and that said Letters Patent are hereby corrected as shown below:

On the title page:

The line reading "[22] Filed: September 30, 1984", should be changed to read [22] Filed: -- September 30, 1987 --.

Signed and Sealed this

Twenty-seventh Day of March, 1990

*Attest:*

JEFFREY M. SAMUELS

*Attesting Officer*

*Acting Commissioner of Patents and Trademarks*